United States Patent [19]

Kleinhappl

[11] Patent Number: 4,910,487

[45] Date of Patent: Mar. 20, 1990

[54] BISTABLE MAGNET

[75] Inventor: Erich Kleinhappl, Graz, Austria

[73] Assignee: AVL AG, Schaffhausen, Switzerland

[21] Appl. No.: 386,997

[22] Filed: Jul. 31, 1989

[30] Foreign Application Priority Data

Dec. 9, 1988 [AT] Austria ..... 3020/88

[51] Int. Cl.[4] ..... H01F 7/08

[52] U.S. Cl. ..... 335/234

[58] Field of Search ..... 335/229, 230, 234, 259, 335/264, 267

[56] References Cited

U.S. PATENT DOCUMENTS

| | | | |
|---|---|---|---|
| 1,817,592 | 8/1931 | Sokoloff | 335/259 |
| 3,713,059 | 1/1973 | Taoa | 335/264 X |
| 3,961,298 | 6/1976 | Jaffe et al. | 335/259 |

*Primary Examiner*—George Harris

*Attorney, Agent, or Firm*—Watson, Cole, Grindle & Watson

[57] ABSTRACT

Bistable magnet, in particular for the actuation of valves and the like, with a movable piston that has a pole face and that is held by a permanent magnet in one of its two stable positions, wherein this piston has a stop face that is provided with a damping plate and that with an opposing face that is built stationary into the housing defines an end position of the piston. To avoid switching noises without decreasing the holding forces it is provided that, in addition to the stop face on the piston, a pole face is provided that interacts with a stationary pole face and that a device that guides the magnetic flux and bridges the air gap between these pole faces is provided between these pole faces.

15 Claims, 3 Drawing Sheets

BISTABLE MAGNET

BACKGROUND OF THE INVENTION

This invention relates to a bistable magnet, in particular for the actuation of valves and the like, with a movable piston that has a pole face and that is held by a permanent magnet in one of its two stable positions, wherein this piston has a stop face that is provided with a damping plate and that with an opposing face, built stationary into the housing, defines an end position of the piston.

DESCRIPTION OF THE PRIOR ART

Such bistable magnets are frequently used to actuate hose squeezing valves, membrane valves, two or more way valves, locking mechanisms, relays, etc. One such magnet can assume two positions, the magnet persisting in each of these two positions without any external influence. A pulse of current, which excites an electromagnetic coil, is necessary only to switch from one position to the other A current flow is not necessary to hold th magnets for either one of the two positions.

Such known, bistable magnets have a movable piston, which can assume tow end positions. In one of these two positions the piston is maximally approached by a permanent magnet so that said piston is held by said magnet in this position. In the other end position the piston is separated from the permanent magnet by means of an air gap, which is so large that the magnetic forces exert only a small effect on the pistion. In this position the piston is held by a spring. an electromagnet coil serves to switch the bistable magnet.

Since the magnetic forces are basically a function of the distance, the piston is accelerated extremely rapidly during the switching process and impacts, therefore, with a relatively high speed on the permanent magnet or a guide plate located between the permanent magnet and the piston. This causes vibrations and a relatively large development of noise, which is undesirable in many cases of application. Other known bistable magnets endeavour to avoid this problem in that a plate that is made of an elastic material and that absorbs the shock upon impact is arranged between the piston and the magnet or the guide plate. In principle, one can cope thus even with the problem of noise development, but this solution has other drawbacks. The result of the plate made of an elastic material is a gap for the magnet field lines so that the holding forces are clearly reduced in this solution.

SUMMARY OF THE INVENTION

An object of the invention is to avoid these drawbacks and to provide a bistable magnet, which exhibits high holding forces yet minimum volume and its noise development during switching processes is minimal.

The invention solves this problem by providing, in addition to the stop face on the piston, a pole face that interacts with a stationary pole face and by providing in the region of these pole faces a device guiding the magnetic flux and bridging the air gap between these pole faces. By separating the stop faces from the pole faces of the piston, the construction design of said faces can be optimal. In particular it is possible in this manner to design the stop faces very large, this feature making it possible to use an especially soft material for the damping plate. In contrast to known solutions, the slight contact pressure does not result in any wearing problems. The dimensions of the individual components are chosen in such a manner that when all of the tolerances are considered and when the damping plates are subject to maximum pressure, without the movement of the device guiding the magnetic flux, a slight air gap always remains between the pole faces. However, this air gap is bridged by means of the magnetic forces induced movement of precisely said device, so that the magnetic field lines can travel exclusively within the ferromagnetic components. The device guiding the magnetic flux has another function, namely to compensate for the tolerance. In particular, the damping plate, which is subject to wear, is the reason for specific tolerances, which cause that end position of the piston, at which the stop face abuts the opposing face, to be subjected to specific changes with time. The more or less strong movement of the device guiding the magnetic flux compensates for said phenomenon. The arrangement of the permanent magnet is, in principle, arbitrary. Generally the present magnet will be built stationary in the housing and the piston will be made solely of ferromagnetic material. However, it is quite possible and, in specific cases of application, logical to design the piston as the permanent magnet so that stationary permanent magnet in the housing may be dropped but does not have to be. Preferably an electromagnetic coil is provided to switch the bistable magnet. Basically the switching process can be triggered mechanically, pneumatically, hydraulically or in any other arbitrary manner. In most cases of application, however, an electric activation will be the method of choice.

A special embodiment of the invention provides that the piston be held by permanent magnets in its engaged position and that a spring be provided that holds the piston in its disengaged position. In this manner the goal of designing an especially simple bistable magnet can be reached. It is also quite possible to design the piston in such a manner that it is held by a permanent magnet in both end positions. In this case the stop faces and the devices guiding the magnetic flux must be designed in duplicate.

It is preferred that the permanent magnet be connected stationary to the housing and that a guide plate against which the magnetic flux guiding device abuts be provided on the side of the permanent magnet facing the piston. Since today's extremely strong permanent magnets do not tolerate much mechanical stress, a guide plate is provided that is to absorb any possible shocks. Another purpose of the guide plate is a certain compensation of the magnetic field lines.

Preferably the magnetic flux guiding device is designed as a short-circuit plate, preferably ring-shaped, that in the engaged position of the piston tips into a tilted position. The short-circuit plate makes contact at one point with the permanent magnet or the guide plate connected thereto and at another point with the piston. Thus a bridging of the air gap is created. in this variation a deformation of the short-circuit plate does not occur.

Especially preferred is that the magnetic flux guiding device be designed as a short-circuit plate, preferably ring-shaped, that in the engaged position of the piston deforms into an essentially conical position. It is important that the short-circuit plate be readily deformable. On the one hand, this can be achieved by using a material having a low modulus of elasticity and, on the other hand, by fashioning this short-circuit plate to match.

The rigidity can always be reduced to the required degree by slots or the like. It is also possible to construct the short-circuit plates of single elements, which are held together by a retaining part such as an O-ring in the circumferential direction.

In order to prevent the short-circuit plate from strikiug the guide plate upon return into the plane position, and thus the noise development, a groove to receive the damping ring is provided in the short-circuit plate. In the simplest case this damping ring is designed as an O-ring.

Furthermore, it can be provided that the magnetic flux guiding device is designed as a package of ring-shaped short-circuit lamella, which in the engaged position of the piston tip into an essentially conical position. Due to the ease with which the lamella can be deformed, an especially good magnetic contact can be produced between the guide plate and the piston. It is also possible to design the magnetic flux guiding device as a soft, ferromagnetic spiral spring. The solution is preferred in cases in which it is mandatory to reduce the noise development to an extreme minimum.

It is also possible to design the magnetic flux guiding device in the form of at least one short-circuit bolt, which can be moved parallel to the piston's direction of movement. A reliable contact between the guide plate and the piston can be produced even in this manner. In practice three to twelve such short-circuit bolts are used.

An especially preferred embodiment of the invention provides that in the engaged position of the piston the magnetic circuit travels enclosed within the components made of ferromagnetic material from the permanent magnet over the front cover plate, the shell, the rear cover plate, the guide bushing, the piston, the short-circuit plate and the guide plate. The result is always significantly high magnetic system efficiancy when the magnetic field lines travel over their entire length within the magnetic guiding materials. Therefore, the effect of the bistable magnet increases even more if not only a favorable connection for the magnetic field from the permanent magnet over the guide plate and the magnetic flux guiding device to the piston is ensured but also the magnetic circuit is closed in the other direction. Thus the field lines travel from the magnet over the front cover plate and the shell to the rear cover plate and from there over the guide bushing again to the piston. It is important that all of the components mentioned be manufactured of ferromagnetic material.

It is preferred that the design be essentially cylindrical, wherein the actuating rod is designed in the region of the axis of the cylinder and can be moved parallel thereto and wherein the permanent magnet and the piston are arranged coaxially to the actuating rod. This makes it possible to design the bistable magnet so as to be strong and compact.

It is also possible to design the housing as a sheet metal strap, which is preferably designed as one piece with the front cover plate. This enables the bistable magnet to be constructed in an especially simple manner. An essentially U-shaped component made of sheet metal represents the housing and the front cover plate.

BRIEF DESCRIPTION OF THE DRAWING

The invention is explained in detail with reference to the embodiments illustrated in the Figures, in which.

DETAILED DESCRIPTION OF PREFERRED EMBODIMENTS

Figure 1:
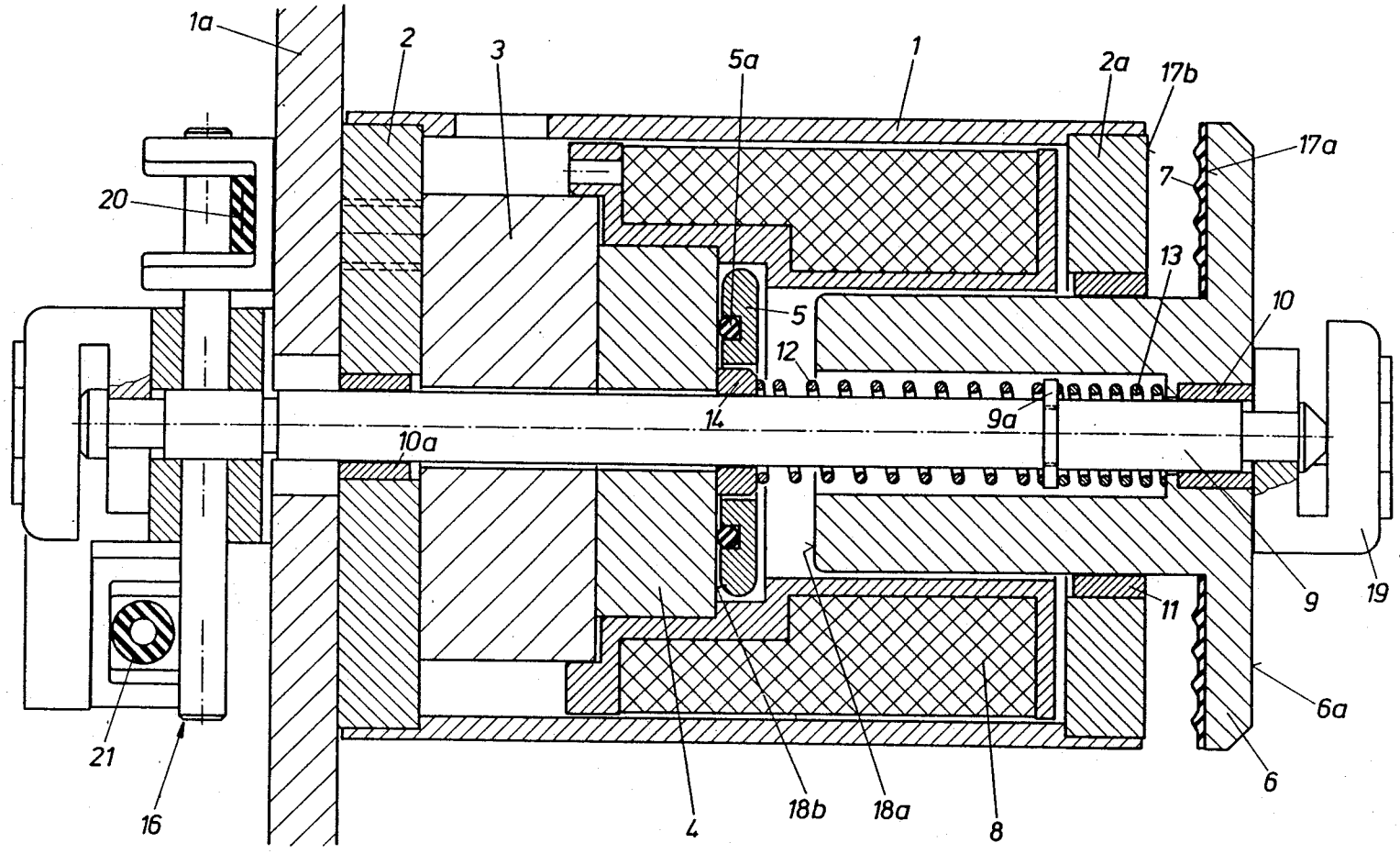
FIG. 1 is a longitudinal view of a bistable magnet of the invention.

The bistable magnet shown in FIG. 1 comprises an essentially cylindrical shell 1, which is connected to a plate 1*a*. Each end of the bistable magnet is closed by means of a front cover plate 2 and a rear cover plate 2*a*. A damping plate 7 is mounted on the stop face 17*a*. A ring-shaped permanent magnet 3 is permanently connected to the front cover plate 2. A guide plate 4 is attached to the permanent magnet 3. An actuating rod 9, which can be moved in the axial direction and serves to actuate a hose squeezing valve 16 is positioned in the center of the bistable magnet. A piston 6 is connected to the actuating rod 9. The piston 6 has a stop face 17*a*, which interacts with a matching opposing face 17*b* on the rear cover plate 2*a*. A damping plate 7 is mounted on the stop face 17*a*. A pole face 18*a*, which interacts with the pole face 18*b* of the magnetic short-circuit plate 5, is provided on the front end of the cylindrical body of the piston 6. In the disengaged state of the piston the magnetic short-circuit plate 5 is vertical and abuts the guide plate 4 via an O-ring 5*a* recessed in a groove. Centering is performed via a sleeve 14, which slides on the actuating rod 9. The piston 6 is positioned in the rear cover plates 2*a* by means of a guide bushing 11 made of ferromagnetic material and connected to the actuating rod 9 by means of a guide bushing 10. Furthermore, the actuating rod 9 is positioned in the front cover plate 2 by means of the guide bushing 10*a*. A compression spring 12 acts between the sleeve 14 and a collar 9*a* of the actuating rod 9 and forces the piston 6 into the disengaged position. The actuating rod 9 can be moved axially with respect to the piston 6. On the one hand, the positioning is the result of mounting the clamp strap 19 on the outer surface 6*a* of the piston 6 and a spring 13, which is braced on the collar 9*a* of the actuating rod 9. When the piston 6 moves into its engaged position and the hose squeezing valve 16 comes to a stop, before the piston 6 is completely in its engaged position and thus the magnet forces have reached their maximum force, then the piston 6 can continue to move even when the actuating rod 9 is being firmly held. Then the spring 13 is compressed and the clamp strap 19 lifts somewhat from the outer surface 6*a* of the piston 6. Thus tolerances can be compensated for in the hose squeezing valve 16.

Moreover, an electromagnet 8 is provided that is positioned stationary in the housing and concentric to the actuating rod 9.

Figure 2:
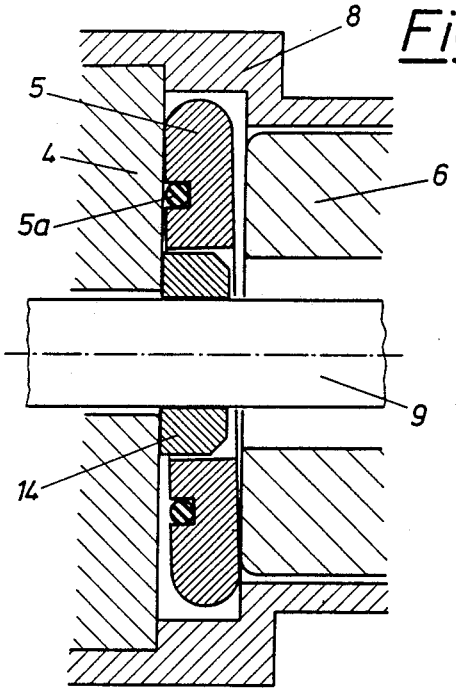
FIG. 2 is a detail of the embodiment of FIG. 1 with engaged piston.

The function of the bistable magnet shown in FIG. 1, is explained in detail. In this Figure the piston 6 is in its disengaged position. The hose 20 of the dual function hose squeezing valve 16 is squeezed. The tube 21 is free in this position. The actuating rod 9 is held in its disengaged position by the force of the compression spring 12. The coil 8 is magnetized by a short pulse of current so that the piston 6 is moved axially counter to the force of the spring 12. The path of the piston 6 is limited by the stop faces 17*a* striking the opposing face 17*b*. The damping plate 7 made of elastic material absorbs the shock upon impact and actively prevents a development of noise. In the engaged position the piston 6 is held by the force of the permanent magnet 3 so that a current flow through the coil 8 is no longer required. The pole faces 18*a* of the piston 6 and 18*b* of the magnetic short-circuit plate 5 come so close to one another that the magnetic short-circuit plate 5 tilts subject to the action of the magnetic forces, as shown in FIG. 2. Thus it is ensured that the magnetic short-circuit plate 5 makes contact with both the guide plate 4 and the piston 6 as well. Therefore, magnetic field lines can travel free of air gaps to the piston 6 from the permanent magnet 3 over the guide plate 4 and the magnetic short-circuit plate 5. In this manner an especially high magnetic force is ensured. The magnetic circuit is closed over the guide bushing 11, the rear cover plate 2*a*, the shell 1, and the front cover plate 2 to the permanent magnet 3. It is important for the function that the shell 1, the cover plates 2 and 2*a*, the guide plate 4, the magnetic short-circuit plate 5, the guide bushing 11, and the piston 6 be made of ferromagnetic material.

The magnetic short-circuit plate 5 travels only a short distance when deformed so that the development of noise is negligibly small.

Figure 2A:
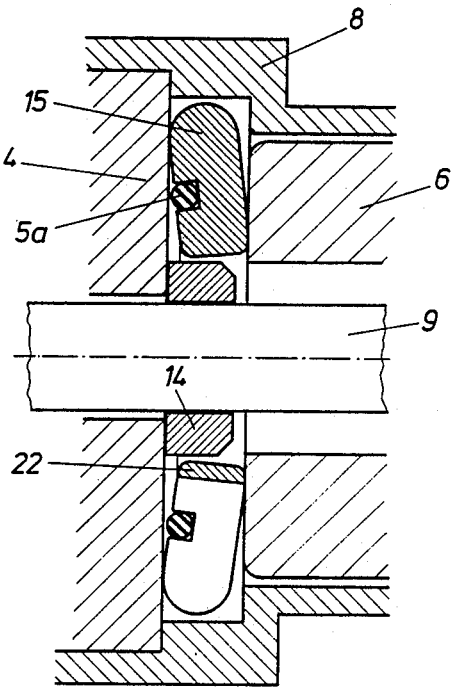
FIGS. 2*a* and 3 to 5 show other details of different embodiments of the invention on an enlarged scale.

The embodiment illustrated in FIGS. 2*a* provides that the magnetic short-circuit plate 15 is deformed subject to the action of magnetic forces, said plate assuming a slightly conical position. To makes the deformation of the magnetic short-circuit plate easier, a number of radial slots are provided. Ribs 22 ensure that the individual segments separated by the slots are held together. It is also possible to omit the ribs 22 so that the individual segments are held together by the O-ring 5*a*.

The piston 6*a* is returned into its original disengaged position by magnetizing the coil 8 by means of an opposing pulse of current. The piston 6 returns into its disengaged position subject to the action of the compression spring 12. The magnetic forces of the permanent magnet 3 are so small in this position due to the relatively large gap between the pole faces 18*a* and 18*b* that the piston 6 is also held in its disengaged position by the spring 12 even after the current flow has been switched off by means of the coil 8. The magnetic short-circuit plate 15 returns into its plane position subject to the action of the elastic forces; thus the damping ring 5*a* effectively prevents a development of noise upon impact on the guide plate 4.

Figure 3:
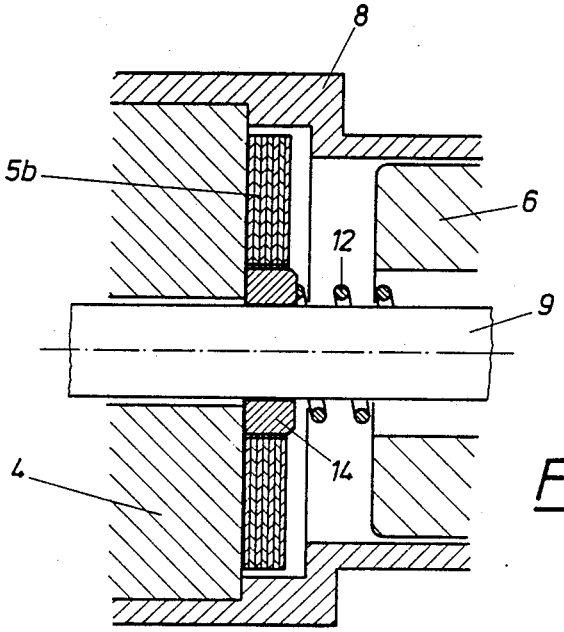

As shown in FIG. 3, the magnetic contact can be produced by means of a package of short-circuit lamella 5*b* that are arranged between the guide plate 4 and the piston 6.

Figure 4:
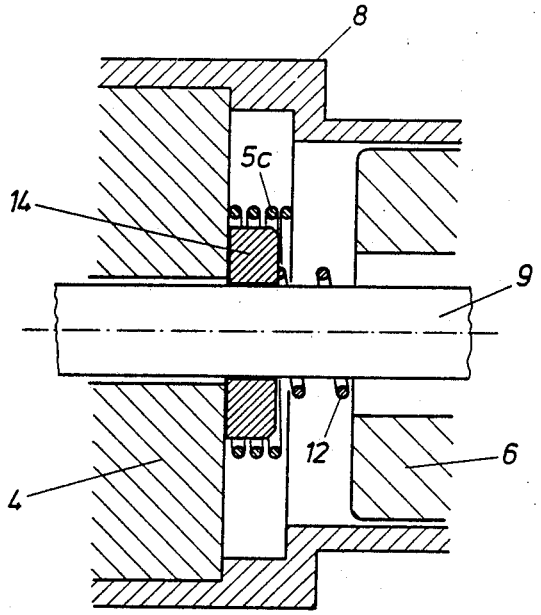

In FIG. 4 a soft spiral spring 5*c* made of ferromagnetic material is provided as the device for guiding the magnetic flux.

Figure 5:
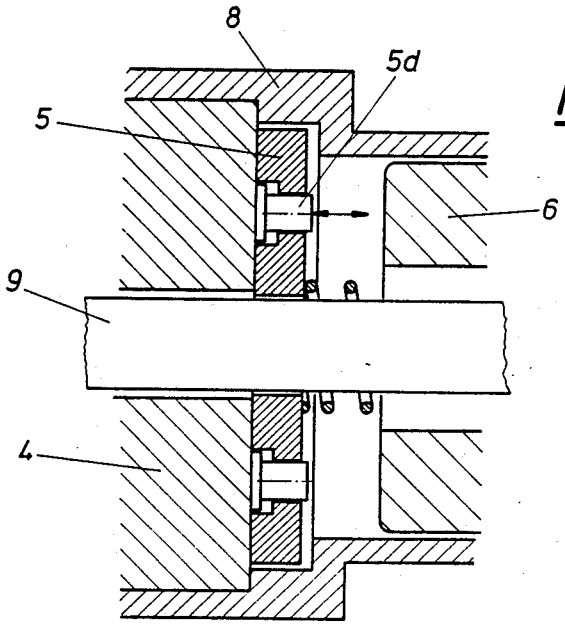

In FIG. 5 the transfer of magnetic field lines is achieved by means of short-circuit bolts 5*d* that can be moved axially.

The solenoid operated valve of the invention achieves with small dimensions extremely high holding forces and exhibits very low noise during the switching process.

We claim:

1. Bistable magnet comprising a housing and a movable piston with a pole face interacting with stationary pole face fixed in said housing, wherein said movable piston is held by a permanent magnet in one of two stable positions, an engaged position and a disengaged position, said piston having a stop face being provided with a damping plate adjacent to an opposing face which is built stationary into said housing defining an end position of said piston, and wherein a device that guides a magnetic flux and bridges an air gap between said pole faces is provided between said pole faces.

2. Bistable magnet, as claimed in claim 1, for actuating valves.

3. Bistable magnet, as claimed in claim 1, wherein an electromagnetic coil is provided to switch said bistable magnet.

4. Bistable magnet, as claimed in claim 1, wherein said piston is held by permanent magnets in said engaged position, and wherein a spring is provided that holds said piston in said disengaged position.

5. Bistable magnet, as claimed in claim 1, wherein said permanent magnet is connected stationary to said housing and wherein a guide plate is provided on said permanent magnet facing said piston and contacting said magnetic flux guiding device.

6. Bistable magnet, as claimed in claim 1, wherein said magnetic flux guiding device is designed as a ring-shaped short-circuit plate, wherein in said engaged position of said piston said short-circuit plate tips into a tilted position.

7. Bistable magnet, as claimed in claim 1, wherein said magnetic flux guiding device is designed as a ring-shaped short-circuit plate, which is deformed into an essentially conical positon in said engaged position of said piston.

8. Bistable magnet, as claimed in claim 5, wherein said short-circuit plate comprises a grooves to receive a damping ring.

9. Bistable magnet, as claimed in claim 6, wherein said short-circuit plate comprises a groove to receive a damping ring.

10. Bistable magnet, as claimed in claim 1, wherein said magnetic flux guiding device is designed as a package of annular short-circuit lamella, said short-circuit lamella tip into an essentially conical position in said engaged position of said piston.

11. Bistable magnet, as claimed is claim 1, wherein said magnetic flux guiding device is designed as a soft ferromagnetic sprial spring.

12. Bistable magnet, as claimed in claim 1, wherein said magnetic flux guiding device comprises at least one short-circuit bolt, which is movable parrallel to the direction of movement of said piston.

13. Bistable magnet, as claimed in claim 1, wherein said housing comprises a front cover plate, a shell, a rear cover plate and a guide bushing, wherein in said engaged position of said piston a magnetic circuit is closed within said permanent magnet, said front cover plate, said shell, said rear cover plate, said guide bushing, said piston, said short-circuit plate and said guide plate, all components made of ferromagnetic materials.

14. Bistable magnet, as claimed in claim 1, with a cylindrical design, wherein and actuating rod of said movable piston is situated coaxially to the axis of said cylindrical bistable magnet and is movable parallel thereto and wherein said permanent magnet and said piston are arranged coaxially to said actuating rod.

15. Bistable magnet, as claimed in claim 13, wherein said housing is designed as a sheet metal strap, which is designed as one piece with said front cover plate.

* * * * *